US012478889B2

(12) United States Patent
Kitamoto

(10) Patent No.: US 12,478,889 B2
(45) Date of Patent: Nov. 25, 2025

(54) SHOULDER JOINT STRUCTURE FOR FIGURE, AND FIGURE

(71) Applicant: SEN-TI-NEL CO., LTD., Tokyo (JP)

(72) Inventor: Takashi Kitamoto, Tokyo (JP)

(73) Assignee: SEN-TI-NEL CO., LTD., Tokyo (JP)

( * ) Notice: Subject to any disclaimer, the term of this patent is extended or adjusted under 35 U.S.C. 154(b) by 195 days.

(21) Appl. No.: 18/515,282

(22) Filed: Nov. 21, 2023

(65) Prior Publication Data

US 2024/0173634 A1 May 30, 2024

(30) Foreign Application Priority Data

Nov. 24, 2022 (JP) ..... 2022-187219

(51) Int. Cl.
*A63H 3/46* (2006.01)

(52) U.S. Cl.
CPC ..... *A63H 3/46* (2013.01)

(58) Field of Classification Search
CPC ..... A63H 3/46
See application file for complete search history.

(56) References Cited

U.S. PATENT DOCUMENTS 4,125,961 A * 11/1978 Yamashina ..... A63H 3/46 446/308
4,673,374 A * 6/1987 Kelley ..... A63H 3/46 446/383
4,680,019 A * 7/1987 Baerenwald ..... A63H 3/46 446/378
6,267,640 B1 * 7/2001 Akashi ..... G09B 23/32 446/376
8,308,524 B2 * 11/2012 deFelice ..... A63H 3/20 446/375
9,566,531 B2 * 2/2017 Hacking ..... A63H 3/16

FOREIGN PATENT DOCUMENTS

| | | | |
|---|---|---|---|
| JP | 2000-140449 | A | 5/2000 |
| JP | 3171931 | U | 11/2011 |
| JP | 6059786 | B1 | 1/2017 |
| JP | 2019-202073 | A | 11/2019 |

* cited by examiner

*Primary Examiner* — John A Ricci
(74) *Attorney, Agent, or Firm* — HAUPTMAN HAM, LLP

(57) ABSTRACT

Provided is a shoulder joint structure for a figure, which makes a shoulder joint of a figure look human-like as much as possible when a corresponding arm of the figure is moved. The shoulder joint structure for a figure includes: a shoulder base part configured to form a base of a shoulder and an underarm of a figure; and an upper arm part to be coupled to the shoulder base part without a gap. The shoulder base part is pivotable about a first pivot axis relative to a body of the figure, the first pivot axis extending sideways and diagonally upward from the figure. The upper arm part is pivotable up and down about a second pivot axis relative to the shoulder base part, the second pivot axis extending in a front-and-rear direction of the figure when the figure has a corresponding arm down.

4 Claims, 6 Drawing Sheets

SHOULDER JOINT STRUCTURE FOR FIGURE, AND FIGURE

RELATED APPLICATIONS

The present application claims priority to Japanese Application Number 2022-187219, filed Nov. 24, 2022, the disclosures of which applications are hereby incorporated by reference herein in their entirety.

BACKGROUND

This disclosure relates to a shoulder joint structure for a figure. This disclosure also relates to a figure having the shoulder joint structure.

There have been known various shoulder joint structures for a figure (see, for example, Japanese Utility Model Registration No. 3171931, Japanese Patent No. 6059786, and Japanese Patent Application Laid-open No. 2019-202073). In general, a shoulder joint structure for a figure is required not only to provide smoothness of arm movement and a sufficient range of motion of an arm but also to make a shoulder joint look natural when the arm is moved.

With most of the related-art shoulder joint structures, however, a shoulder joint looks unnatural and unrealistic when a corresponding arm is moved. For example, as illustrated in FIG. 8, when an arm is raised, an area around a shoulder joint is substantially exposed; as illustrated in FIG. 9, when a corresponding arm is rotated, a shoulder forms a shape that is impossible for a human body to make; and as illustrated in FIG. 10, when a corresponding arm is raised, a shoulder is turned downward. It is preferred that, when an arm of a figure is moved, a shoulder joint look human-like as much as possible.

SUMMARY

This disclosure has been made in view of the circumstances described above, and has an object to provide a shoulder joint structure for a figure, which makes a shoulder joint of a figure look human-like as much as possible when a corresponding arm of the figure is moved.

This disclosure has another object to provide a figure having the shoulder joint structure.

In order to solve the above-mentioned problem, according to this disclosure, there is provided a shoulder joint structure for a figure, including: a shoulder base part configured to form a base of a shoulder and an underarm of a figure; and an upper arm part to be coupled to the shoulder base part without a gap. The shoulder base part is pivotable about a first pivot axis relative to a body of the figure, the first pivot axis extending sideways and diagonally upward from the figure. The upper arm part is pivotable up and down about a second pivot axis relative to the shoulder base part, the second pivot axis extending in a front-and-rear direction of the figure when the figure has a corresponding arm down. The shoulder base part includes: a base portion having one of a cylindrical shape or a truncated conical shape with the first pivot axis as a center axis; and any one of a front shoulder portion configured to form a front side of the shoulder of the figure or a rear shoulder portion configured to form a rear side of the shoulder when the figure has the corresponding arm down. The upper arm part includes another one of the front shoulder portion configured to form the front side of the shoulder of the figure or the rear shoulder portion configured to form the rear side of the shoulder when the figure has the corresponding arm down.

A pivot coupling portion having the second pivot axis is provided between the front shoulder portion and the rear shoulder portion.

According to this disclosure, the shoulder base part is pivotable on the body of the figure about the first pivot axis extending sideways and diagonally upward from the figure. Meanwhile, the upper arm part is pivotable up and down on the shoulder base part about the second pivot axis extending in the front-and-rear direction when the figure has its corresponding arm down. A motion of raising and lowering the arm of the figure corresponds to a combined motion of pivoting of the shoulder base part on the body and pivoting of the upper arm part on the shoulder base part. The shoulder base part forms the base of the shoulder and the underarm of the figure. Thus, even when the arm is raised high, the underarm and the shoulder joint of the figure appear as natural and human-like ones.

As one embodiment of this disclosure, when the upper arm part is pivoted upward with respect to the shoulder base part, a part of the upper arm part and a part of the shoulder base part may overlap each other to prevent mutual interference between the upper arm part and the shoulder base part.

As one embodiment of this disclosure, the first pivot axis may extend sideways and diagonally upward and rearward from the figure. Such inclination of the first pivot axis allows the shoulder base part to look most natural and realistic when the figure is posed with its arms down, back straight, and chest out. Further, the inclination of the first pivot axis as described above allows the shoulder base part to be moved in a manner similar to that of a human body when the shoulder base part is pivoted on the body about the first pivot axis. At the same time, the shoulder and the underarm of the figure look human-like.

According to this disclosure, there is provided a figure including the shoulder joint structure.

BRIEF DESCRIPTION OF THE DRAWINGS

FIG. 3A and FIG. 3B are views for illustrating a central chest member illustrated in FIG. 2, in which FIG. 3A is a front view and FIG. 3B is a plan view (top view).

FIG. 6A and FIG. 6B are views of the figure having the shoulder joint structures illustrated in FIG. 4 and FIG. 5 when a left arm of the figure is extended forward, in which FIG. 6A is a side view and FIG. 6B is a rear perspective view.

FIG. 7A, FIG. 7B, and FIG. 7C are views of the figure having the shoulder joint structures illustrated in FIG. 4 and FIG. 5 when the left arm of the figure is raised straight up, in which FIG. 7A is a front view, FIG. 7B is a side view, and FIG. 7C is a rear perspective view.

DESCRIPTION OF THE EMBODIMENTS

Now, with reference to the accompanying drawings, an embodiment of this disclosure is described.

Figure 1:
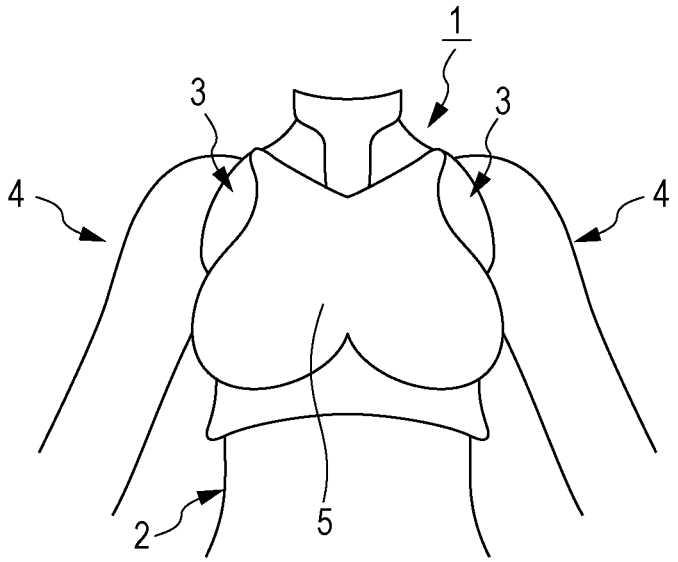
FIG. 1 is a front view of a main part of an upper body of a figure having shoulder joint structures according to one embodiment of this disclosure.

As illustrated in FIG. 1, a FIG. 1 according to one embodiment of this disclosure includes a body 2, a pair of shoulder base parts 3 (right and left shoulder base parts 3), and a pair of upper arm parts 4 (right and left upper arm parts 4). A chest member 5 is arranged on a front side of the body 2, which corresponds to a chest. As is well known, the FIG. 1 is made up of a plurality of components. The components of the FIG. 1 are molded articles made of plastic. However, the components are not limited to molded articles made of plastic.

Figure 2:
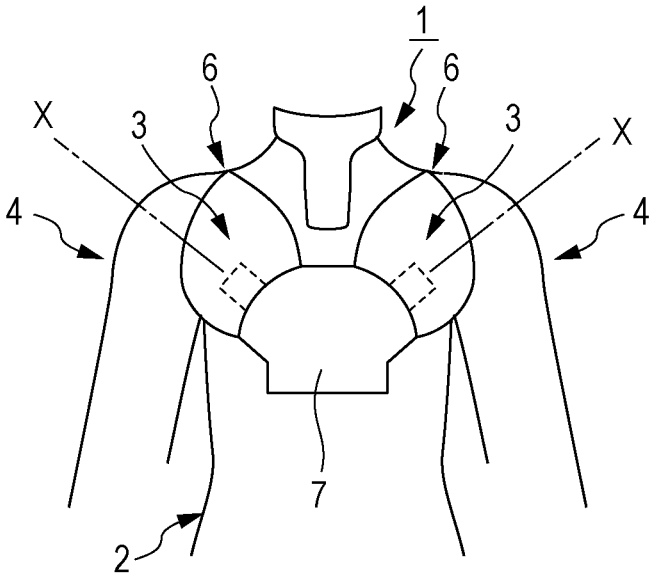
FIG. 2 is a front view of the shoulder joint structures according to the one embodiment of this disclosure after a chest member is removed from the figure illustrated in FIG. 1.

After the chest member 5 is removed from the FIG. 1 illustrated in FIG. 1, shoulder joint structures 6 illustrated in FIG. 2 according to the one embodiment of this disclosure are exposed. As illustrated in FIG. 2, a central chest member 7 is disposed at a center position in a chest of the FIG. 1. The central chest member 7 forms a part of the body 2. The right and left shoulder base parts 3 are attached to the central chest member 7, and the right and left shoulder base parts 4 are attached to the right and left shoulder base parts 3, respectively. Each of the shoulder base parts 3 serves to form a base of a shoulder and an underarm of the FIG. 1. The right and left shoulder base parts 3 are located inside a body line of the FIG. 1 and are each pivotable about a first pivot axis X with respect to the body 2. The first pivot axis X extends sideways and diagonally upward from the FIG. 1.

Figure 3A:
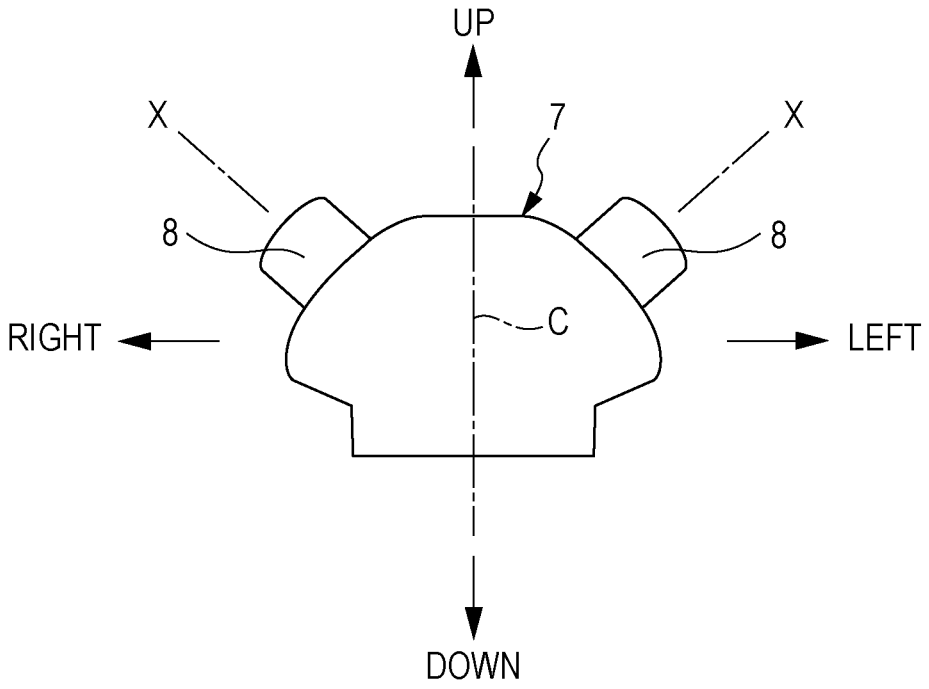

As illustrated in FIG. 3A, the central chest member 7 has a pair of first shaft portions 8 (right and left first shaft portions 8). The first shaft portions 8 have the same shape and are arranged laterally symmetrical with respect to a vertical center axis C of the FIG. 1. Each of the first shaft portions 8 is formed in a cylindrical shape with a small length, and has a center axis X extending sideways and diagonally upward from the FIG. 1. The center axis corresponds to the first pivot axis X about which the shoulder base part 3 is pivoted. The central chest member 7 appropriately includes coupling portions for coupling to other components of the FIG. 1. However, the coupling portions are not relevant to the gist of this disclosure. Thus, a detailed illustration of the coupling portions is omitted.

Figure 3B:
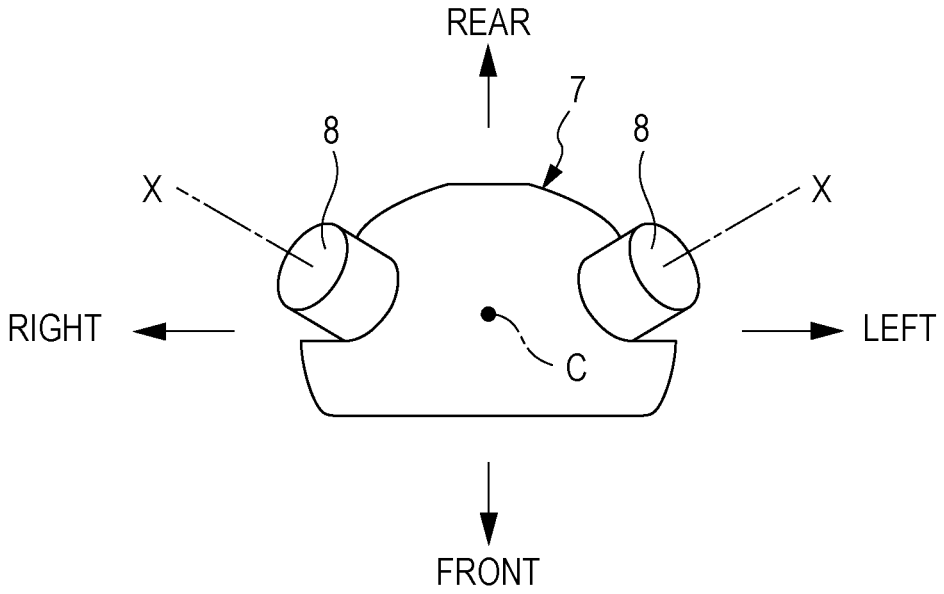

As illustrated in FIG. 3A, it is preferred that the first pivot axis X extend sideways and diagonally upward from the FIG. 1. Further, as illustrated in FIG. 3B, it is more preferred that the first pivot axis X extend sideways and diagonally upward and rearward from the FIG. 1. In this case, when the FIG. 1 is posed with its arms down, back straight, and chest out, the shoulder base parts 3 look most natural and realistic. Further, because of inclination of the first pivot axis X as described above, when the shoulder base part 3 is pivoted on the body 2 about the first pivot axis X, the shoulder base part 3 is moved in a manner similar to that of movement of a human body. At the same time, shoulders and underarms of the FIG. 1 look human-like.

Figure 4:
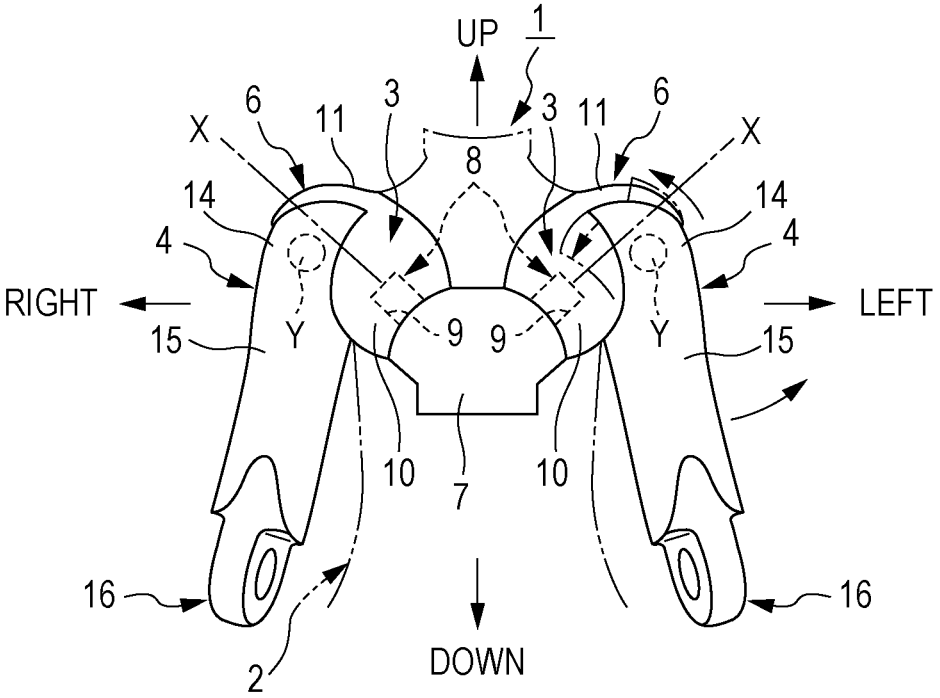
FIG. 4 is a detailed front view of the shoulder joint structures illustrated in FIG. 2.

As illustrated in FIG. 4, a first shaft receiving hole 9 having a cylindrical shape is formed in the shoulder base part 3 so as to correspond to each of the first shaft portions 8 formed on the central chest member 7. The first shaft portion 8 and a corresponding one of the first shaft receiving portions 9 are tightly fitted together in a press-fit manner to allow pivoting of the shoulder base part 3 relative to the central chest member 7. Thus, the shoulder base part 3 is pivotable around a corresponding one of the first shaft portions 8 of the central chest member 7. Each of the shoulder base parts 3 includes a portion having a cylindrical or truncated conical shape with the first pivot axis as a center axis.

The coupling between the central chest member 7 and the shoulder base part 3, which allows pivoting of the shoulder base part 3 about the first pivot axis X relative to the central chest member 7, may also be achieved with an interchanged relationship between the first shaft portion and the first shaft receiving hole. Specifically, a first shaft portion may be formed on each of the shoulder base parts 3, and a first shaft receiving hole to be fitted over the first shaft portion may be formed in the central chest member 7.

Figure 5:
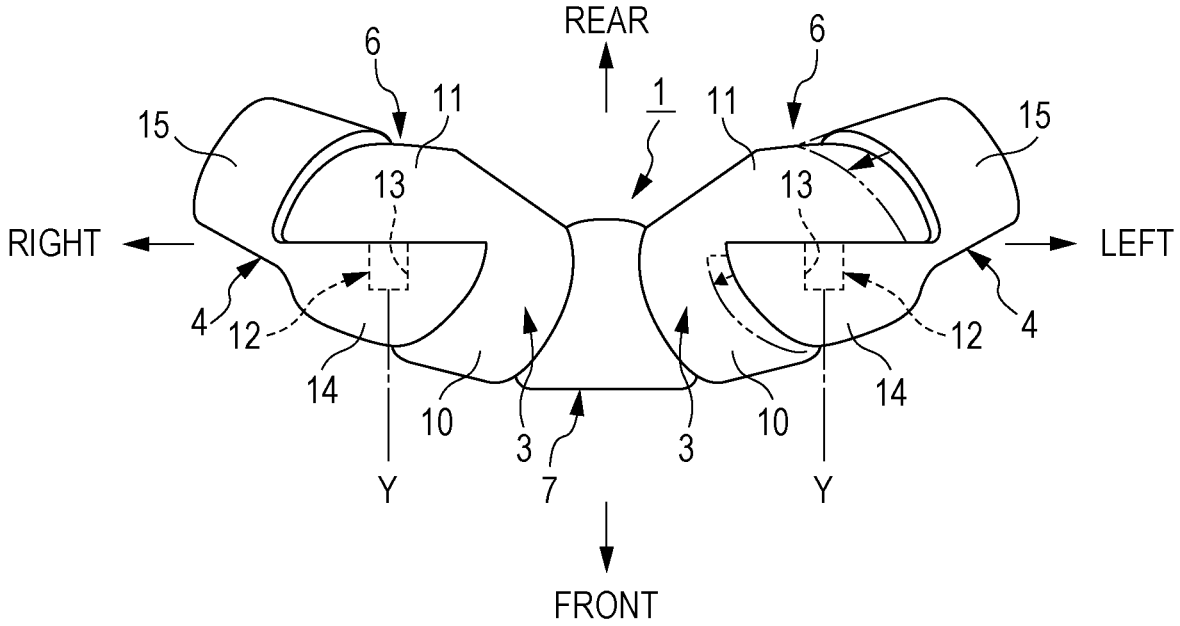
FIG. 5 is a plan view of the shoulder joint structures illustrated in FIG. 4.

The shoulder base part 3 is described in detail with reference to FIG. 4 and FIG. 5. The shoulder base part 3 includes a base portion 10 and a rear shoulder portion 11. The base portion 10 has a cylindrical or truncated conical shape having the first pivot axis X as a center axis. The rear shoulder portion 11 has a semi-spherical shape and is continuous with a rear-side half of the base portion 10. The first shaft receiving hole 9 is formed in a surface of the base portion 10 on a side closer to the central chest member 7. Meanwhile, the rear shoulder portion 11 projects in a semi-spherical manner to a rear side of the FIG. 1 when the FIG. 1 has its corresponding arm down. The rear shoulder portion 11 forms a rear side of a shoulder of the FIG. 1. A front surface of the rear shoulder portion 11 is a flat surface facing forward. A second shaft portion 12 is formed in a protruding manner at a center of the front surface of the rear shoulder portion 11. As illustrated in FIG. 5, the second shaft portion 12 extends forward with respect to the FIG. 1 and has a short length.

The description is continued with reference to FIG. 4 and FIG. 5. Each of the upper arm parts 4 is pivotable about a second pivot axis Y with respect to a corresponding one of the shoulder base parts 3. When the FIG. 1 has its corresponding arm down, the second pivot axis Y extends in a front-and-rear direction of the FIG. 1. A center axis of the second shaft portion 12 on the shoulder base part 3 corresponds to the second pivot axis Y. A second shaft receiving hole 13 having a cylindrical shape is formed in the upper arm part 4 so as to correspond to the second shaft portion 12 of the shoulder base part 3. The second shaft receiving hole 13 and the second shaft portion 12 are tightly fitted together in a press-fit manner to allow pivoting of the upper arm part 4 relative to the shoulder base part 3. Thus, each of the upper arm parts 4 can be freely pivoted around the second shaft portion 12 on the shoulder base part 3. The second shaft portion 12 and the second shaft receiving hole 13 are fitted together and form a pivot coupling portion for coupling the shoulder base part 3 and a corresponding one of the upper arm parts 4 so as to allow the pivoting of the upper arm part 4 relative to the shoulder base part 3.

In the configuration described above, each of the upper arm parts 4 is pivotable up and down about the second pivot axis Y on the shoulder base part 3. When the FIG. 1 has its corresponding arm down, the second pivot axis Y extends in the front-and-rear direction (see FIG. 5). Thus, when the upper arm part 4 is pivoted upward about the second pivot axis Y from a state in which the FIG. 1 has it corresponding arm down, a motion of raising the upper arm part 4 is performed on a side of a body of the FIG. 1. The shoulder base part 3 forms the base of the shoulder and the underarm of the FIG. 1. Thus, when the FIG. 1 has its upper arm part 4 up, the FIG. 1 with this posture substantially corresponds to a human body with an arm up. The movement of the arm of the FIG. 1 corresponds to combined movement of pivoting of the shoulder base part 3 about the first pivot axis X and pivoting of the upper arm part 4 about the second pivot axis Y.

The upper arm part 4 is described in detail with reference to FIG. 4 and FIG. 5. Each of the upper arm parts 4 includes a front shoulder portion 14 and an upper arm main body 15. The front shoulder portion 14 has a semi-spherical shape. The upper arm main body 15 has a cylindrical shape and is continuous with the front shoulder portion 14. When the FIG. 1 has its arms down (see FIG. 5), the front shoulder portion 14 projects in a semi-spherical manner toward the front side of the FIG. 1 and forms a front side of the shoulder of the FIG. 1. When the FIG. 1 has its arms down, the front shoulder portion 14 forms the shoulder of the FIG. 1 integrally with a corresponding one of the rear shoulder portions 11 of the shoulder base parts 3, which has a semi-spherical shape. A rear surface of the front shoulder portion 14 is a flat surface facing backward. The second shaft receiving hole 13 is formed at a center of the rear surface of the front shoulder portion 14.

The coupling between the shoulder base part 3 and the upper arm part 4, which allows the pivoting of the upper arm part 4 about the second pivot axis Y relative to the shoulder base part 3, may be achieved with an interchanged relationship between the second shaft portion and the second shaft receiving hole. Specifically, a second shaft portion may be formed on the upper arm part 4, and a second shaft receiving hole to be fitted over the second shaft portion may be formed in the shoulder base part 3.

As illustrated in FIG. 4 and FIG. 5, no gap is found between the shoulder base part 3 and the upper arm part 4 when the FIG. 1 has its arms down. Further, when the upper arm part 4 is pivoted upward on a corresponding one of the shoulder base parts 3, a part of the upper arm part 4 and a part of the shoulder base part 3 overlap each other. Thus, a gap is not generated between the shoulder base part 3 and the upper arm part 4 regardless of whether the FIG. 1 has its arms down or up.

Specifically, when the upper arm part 4 is pivoted upward about the second pivot axis Y on the shoulder base part 3, the front shoulder portion 14 of the upper arm part 4 is moved into under the base portion 10 of the shoulder base part 3 as illustrated in FIG. 4 and FIG. 5. At the same time, the rear shoulder portion 11 of the shoulder base part 3 is moved into under the upper arm main body 15 of the upper arm part 4. As a result, when the upper arm part 4 is pivoted upward on the shoulder base part 3, mutual interference between the upper arm part 4 and the shoulder base part 3 can be prevented. At the same time, a gap can be prevented from being generated between the shoulder base part 3 and the upper arm part 4.

As illustrated in FIG. 4, an elbow joint part 16, which serves as a coupling part for coupling to a lower arm part (not shown), is provided at a distal end (lower end in FIG. 4) of each of the upper arm parts 4. The elbow joint part 16 is not relevant to the gist of this disclosure, and thus a detailed description thereof is omitted.

Each of the shoulder base parts 3 and the upper arm parts 4 has been described as a single component. However, in view of ease of formation of the shoulder base parts 3 and the upper arm parts 4, it is apparent that each of the shoulder base parts 3 and the upper arm parts 4 may be formed as an assembled part made up of a plurality of parts.

There has been described with reference to FIG. 4 and FIG. 5 the embodiment in which each of the shoulder base parts 3 includes the rear shoulder portion 11, each of the upper arm parts 4 includes the front shoulder portion 14, and the rear shoulder portion 11 and the front shoulder portion 14 are coupled to each other so as to allow pivoting of the upper arm part 4 relative to the shoulder base part 3. However, an embodiment using an interchanged relationship between the front shoulder portion 14 and the rear shoulder portion 11 is also possible. Specifically, each of the shoulder base parts 3 includes the front shoulder portion 14, each of the upper arm parts 4 includes the rear shoulder portion 11, and the front shoulder portion 14 and the rear shoulder portion 11 are coupled to each other so as to allow pivoting of the upper arm part 4 relative to the shoulder base part 3. Also in this case, it is apparent that, when each of the upper arm parts 4 is pivoted upward on the shoulder base part 3, a part of the upper arm part 4 and a part of the shoulder base part 3 overlap each other.

Next, with reference to FIG. 6A and FIG. 6B and FIG. 7A to FIG. 7C, actions and effects of the shoulder joint structure 6 illustrated in FIG. 4 and FIG. 5 are described.

Figure 6A:
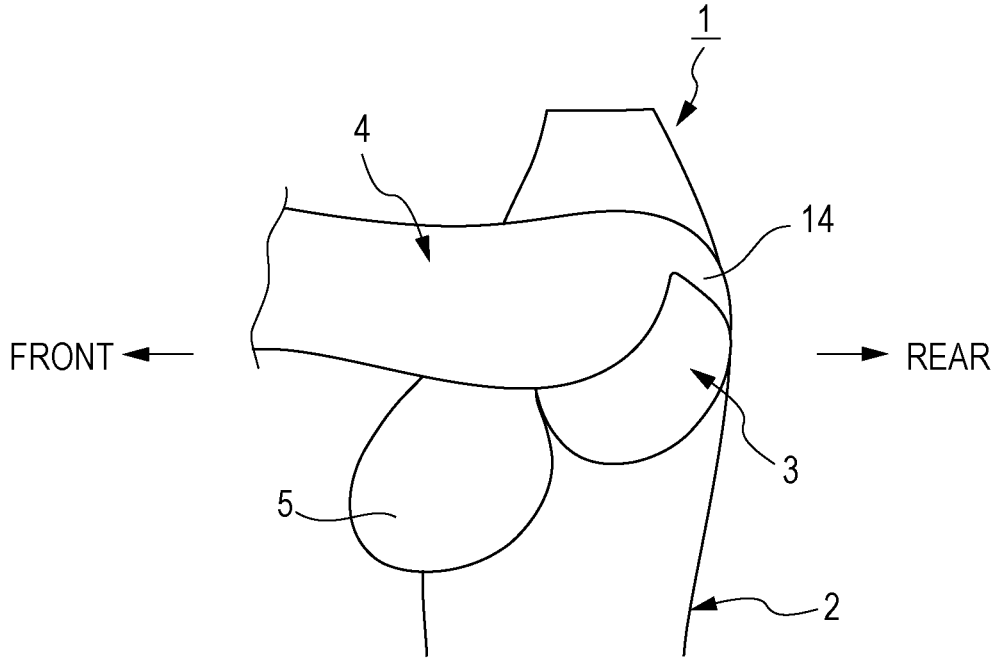
Figure 6B:
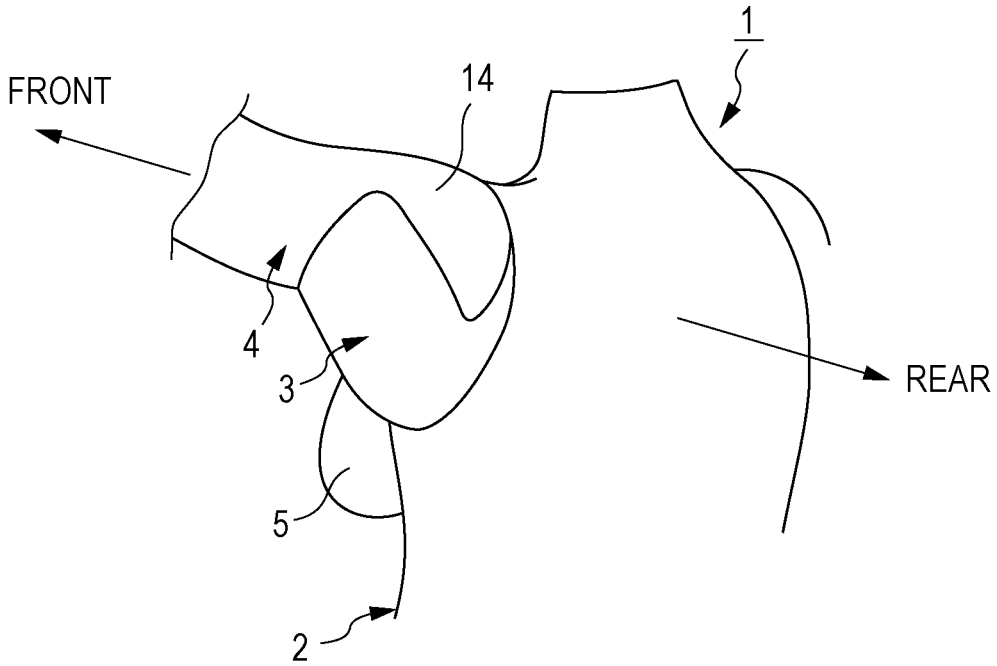

FIG. 6A is a side view of the FIG. 1 having the shoulder joint structure 6 illustrated in FIG. 4 and FIG. 5 when a left arm of the FIG. 1 is extended forward. Further, FIG. 6B is a rear perspective view of the FIG. 1 illustrated in FIG. 6A. A motion of raising the left arm of the FIG. 1 forward from below to a level of the shoulder corresponds to a motion of pivoting upward the shoulder base part 3 about the first pivot axis X on the body 2 to a horizontal level. At the end of this motion, as illustrated in FIG. 6A and FIG. 6B, the shoulder base part 3 appears as an underarm of the FIG. 1, and the front shoulder portion 14 of the upper arm part 4 appears as a shoulder. Thus, the shoulder joint of the FIG. 1 looks human-like.

Figure 7A:
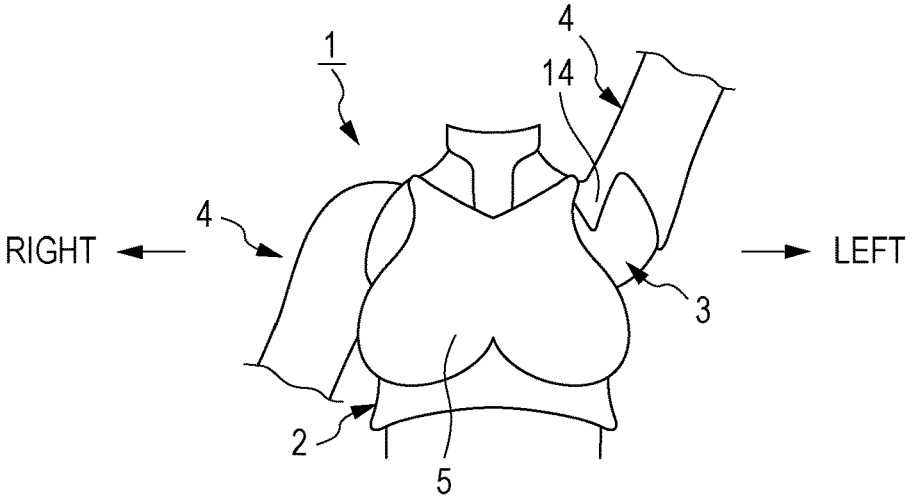
Figure 7B:
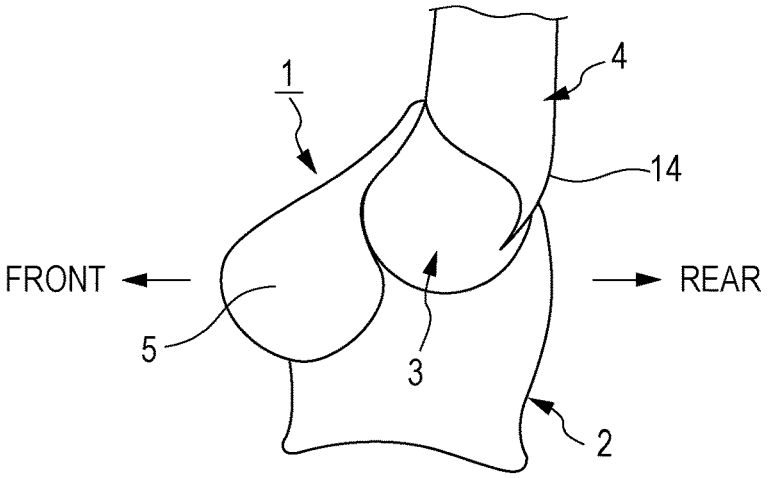
Figure 7C:
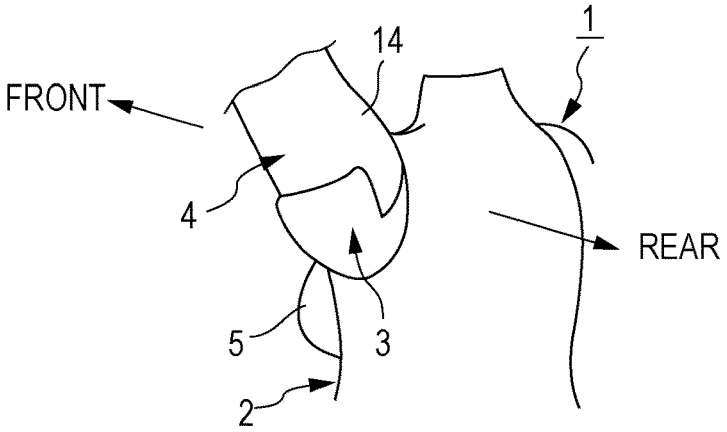
Figure 8:
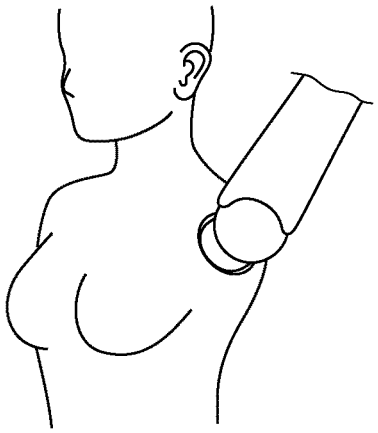
FIG. 8 is a perspective view of a first example of a related-art shoulder joint structure.
Figure 9:
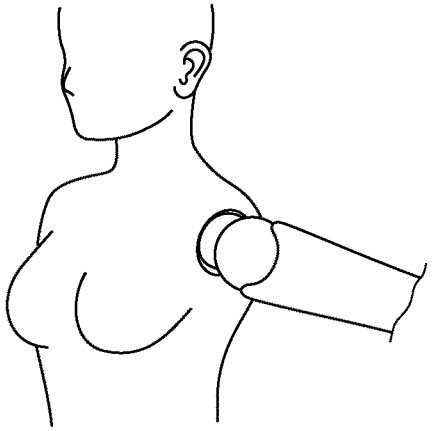
FIG. 9 is a perspective view of a second example of the related-art shoulder joint structure.
Figure 10:
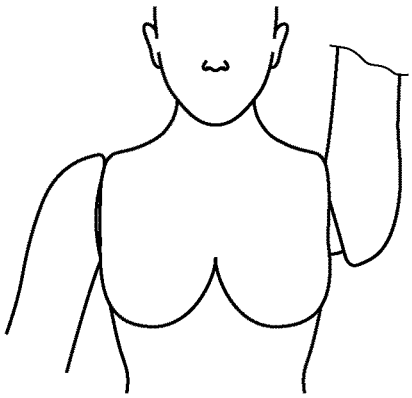
FIG. 10 is a front view of a third example of the related-art shoulder joint structure.

FIG. 7A is a front view of the FIG. 1 having the shoulder joint structure 6 illustrated in FIG. 4 and FIG. 5 when the left arm of the FIG. 1 is extended straight up. FIG. 7B is a side view of the FIG. 1 illustrated in FIG. 7A. FIG. 7C is a rear perspective view of the FIG. 1 illustrated in FIG. 7A. A motion of extending the left arm of the FIG. 1 straight up corresponds to a combination of a motion of pivoting upward the shoulder base part 3 about the first pivot axis X on the body 2 and a motion of pivoting upward the upper arm part 4 about the second pivot axis Y on the shoulder base part 3. At the end of this motion, as illustrated in FIG. 7A to FIG. 7C, the shoulder base part 3 appears as an underarm of the FIG. 1, and the front shoulder portion 14 of the upper arm part 4 appears as a shoulder. Thus, the shoulder joint of the FIG. 1 looks human-like.

The embodiments of this disclosure have been described in detail with reference to the drawings. However, a specific configuration is not limited to those of the embodiments described above. For example, changes in design without departing from the gist of this disclosure are encompassed in this disclosure. Further, technologies in the above-mentioned embodiments described above may be used in combination as long as there is no particular contradiction or problem in, for example, purpose and configuration.

What is claimed is:

1. A shoulder joint structure for a figure, comprising:

a shoulder base part configured to form a base of a shoulder and an underarm of a figure; and an upper arm part to be coupled to the shoulder base part without a gap, wherein the shoulder base part is pivotable about a first pivot axis relative to a body of the figure, the first pivot axis extending sideways and diagonally upward from the figure, wherein the upper arm part is pivotable up and down about a second pivot axis relative to the shoulder base part, the second pivot axis extending in a front-and-rear direction of the figure when the figure has a corresponding arm down, wherein the shoulder base part includes:

a base portion having one of a cylindrical shape or a truncated conical shape with the first pivot axis as a center axis; and any one of a front shoulder portion configured to form a front side of the shoulder of the figure or a rear shoulder portion configured to form a rear side of the shoulder when the figure has the corresponding arm down, wherein the upper arm part includes another one of the front shoulder portion configured to form the front side of the shoulder of the figure or the rear shoulder portion configured to form the rear side of the shoulder when the figure has the corresponding arm down, and wherein a pivot coupling portion having the second pivot axis is provided between the front shoulder portion and the rear shoulder portion.

2. The shoulder joint structure for a figure according to claim 1, wherein, when the upper arm part is pivoted upward with respect to the shoulder base part, a part of the upper arm part and a part of the shoulder base part overlap each other to prevent mutual interference between the upper arm part and the shoulder base part.

3. The shoulder joint structure for a figure according to claim 1, wherein the first pivot axis extends sideways and diagonally upward and rearward from the figure.

4. A figure comprising the shoulder joint structure of claim 1.

* * * * *